US005769709A

United States Patent [19]

Kim

[11] Patent Number: 5,769,709

[45] Date of Patent: Jun. 23, 1998

[54] AIR CONDITIONER HAVING AIR PORTS OPENED AND CLOSED BY ROTATABLE BLADES

[75] Inventor: Do-Yeon Kim, Euwang, Rep. of Korea

[73] Assignee: Samsung Electronics Co., Ltd., Suwon, Rep. of Korea

[21] Appl. No.: 819,976

[22] Filed: Mar. 18, 1997

[30] Foreign Application Priority Data

| | | | |
|---|---|---|---|
| Mar. 21, 1996 | [KR] | Rep. of Korea | 1996-7770 |
| Mar. 21, 1996 | [KR] | Rep. of Korea | 1996-7773 |
| Dec. 3, 1996 | [KR] | Rep. of Korea | 1996-61289 |

[51] Int. Cl.[6] ..... F24F 13/15

[52] U.S. Cl. ..... 454/318; 454/233; 454/335

[58] Field of Search ..... 454/233, 234, 454/315, 318, 319, 320, 321, 325, 335

[56] References Cited

U.S. PATENT DOCUMENTS

| | | | |
|---|---|---|---|
| 1,070,312 | 8/1913 | Wilson | 454/318 X |
| 1,737,946 | 12/1929 | Rood | 454/335 |
| 2,293,065 | 8/1942 | Kiczales | 454/335 |
| 3,196,895 | 7/1965 | Dayus | 454/335 X |
| 5,388,426 | 2/1995 | Wada et al. | 62/263 |

FOREIGN PATENT DOCUMENTS

| | | | |
|---|---|---|---|
| 739895 | 11/1955 | United Kingdom | 454/335 |

*Primary Examiner*—Harold Joyce
*Attorney, Agent, or Firm*—Burns, Doane, Swecker & Mathis, L.L.P.

[57] ABSTRACT

An air conditioner includes an air suction port and an air outlet port. Sets of horizontal blades extend across respective ports and are rotatable about horizontal axes for opening and closing the respective port. Each set of blades includes lugs movable in an inclined slot formed in a respective linearly movable cam member to produce rotation of the blades in response to linear movement of the cam member. Each lug is also movable in a curved slot of a separate guide member to guide the rotational movement of the blade. Each inclined slot includes a linear inclined section and may include vertical extensions at each end of the linear section. The cam member can produce different angles of rotation of the blades so that, due to an optical illusion, the blades appear to a viewer to have been rotated by equal angles.

11 Claims, 15 Drawing Sheets

AIR CONDITIONER HAVING AIR PORTS OPENED AND CLOSED BY ROTATABLE BLADES

BACKGROUND OF THE INVENTION

1. Field of the Invention

This invention relates, in general, to an air conditioner having shutter means which close or open suction and exhaust ports and control air flow direction.

2. Description of the Prior Art

FIG. 1 shows a construction of a typical air conditioner. As shown in the drawing, the typical air conditioner has a room air suction grille 3 installed across a suction port 2 of a housing 1. The room air suction grille 3 has a plurality of suction ports 3*a* which introduce the room air into the housing 1.

Mounted behind the room air suction grille 3 is a filter 5 for filtering various harmful substances and the like from the air sucked from the suction ports 3*a* of the room air suction grille 3. A heat exchanger 7 is installed inside the housing 1 so that the air purified by the filter 5 is heated or cooled. A duct 9 is installed above the heat exchanger 7 to thereby guide into an upper side of the housing 1 the heated or cooled air, which has passed through the heat exchanger 7. A blower fan 11 is rotatably installed inside the duct 9, and supplies a suction power to move the sucked room air to an upper side of the housing 1. Mounted at one side of the duct 9 is first drive means 13, which generates a rotating power to rotate the blower fan 11. A holder panel 15 is vertically installed at a front section of the duct 9 inside the housing 1.

Second drive means 17 is mounted on the holder panel 15 and connected to a power supply (not shown) so that an electric power is applied thereto. A pinion gear 21 is mounted to an output shaft 19 of the second drive means 17 and rotated in forward and backward directions by rotational force of the second drive means 17.

A vertical rack gear 23 meshes with the pinion gear 21 to thereby convert a reversible rotating motion of the pinion gear 21 to a vertical linear reciprocating motion. Shutter means 27 is mounted to the rack gear 23 to selectively close an exhaust port 25 in accordance with the vertical movement of the rack gear 23.

Two types of movable air exhaust grilles 29 and 31, which respectively control the exhaust air in the vertical and horizontal directions, are set at an upper section of the holder panel 15. Room air is sucked into the housing 1 through the suction ports 3*a* of the suction grille 3 and is cooled by an evaporator of the air conditioner prior to being discharged into the room through the exhaust port 25. When the cold air is discharged into the room, the air flow direction is controlled by the exhaust grilles 29 and 31.

When the air conditioner is not used, the exhaust port 25 is closed by operating an associated button at the control panel. Electric power of the power source is applied to second drive means 17 so that the means 17 can be rotated in the forward direction.

The output shaft 19 mounted to second drive means 17, is rotated in the forward direction. Thus the pinion gear 21 mounted to the output shaft 19, is rotated in the forward direction.

The rack gear 23 is moved upward and the shutter means 27 connected to the rack gear 23 is moved upward at the same time. Thus the exhaust port 25 is closed to thereby prevent introduction of foreign substances such as dust into the housing 1 through the exhaust port 25 while the air conditioner is not used.

And, when the air conditioner is used, a control panel button associated with the exhaust port 25 is manipulated such that the second drive means 17 is rotated in the reverse direction and simultaneously the pinion gear 21 is rotated in the reverse direction. Thus the rack gear 23 connected to the pinion gear 21, is moved downward to open the exhaust port 25.

Meanwhile, the first drive means 13 is operated to rotate the blower fan 11. Thus the room air is sucked into the housing 1 through a plurality of suction ports 3*a* of the suction grille 3 by suction power of the blower fan 11. Various harmful substances and the like contained in sucked air is filtered by the filter 5. The sucked air is heated or cooled by the heat exchanger 7, and simultaneously guided by the duct 9 to be discharged into the exhaust port 25 of the housing 1 through the heat exchanger 7.

At this time, the air passes through the exhaust port 25 and is controlled by the movable air exhaust grilles 29 and 31, which control the exhaust air in the vertical and horizontal directions respectively. The air is discharged into the room through the opened exhaust port 25 to heat or cool the air in the room.

However, there is a problem in the above air conditioner in that, to order to provide an ample supply of air, a plurality of suction ports 3*a* must be provided which detract from an external appearance of the housing.

There is another problem in that, when the air conditioner is not used, foreign substances such as dust may be introduced into the housing 1 through the suction ports 3*a*.

There is still another problem in that at a side of exhaust port 25, the shutter means 27 and the movable cold air exhaust grille 29 are disposed which are operated independently of one another, thereby complicating the construction of the air conditioner.

SUMMARY OF THE INVENTION

It is, therefore, an object of the invention to provide an air conditioner having shutter means which close or open suction and exhaust ports and control an air flow direction, and more particularly to an air conditioner having enlarged suction and exhaust ports to increase an amount of inlet air of the air conditioner and to maintain a good external appearance thereof.

It is another object of the present invention to provide an air conditioner adapted to control a shutter consisting of a plurality of separate opening and closing vanes whose degree of openness is respectively and differently adjusted among one another so that the vanes seem to be opened at an equal angle due to an optical illusion.

In order to accomplish the above objects, there is provided an air conditioner, the air conditioner comprising:

cam means meshing with a pinion gear for movement in vertical directions;

a plurality of shutter blades to close or open a suction port or a exhaust port, and rotated by an interlock motion with the cam means, which is vertically moving; and guide means for rotatively supporting a plurality of the shutter means to thereby guide a rotary movement thereof.

In accordance with another object of the present invention, there is provided an air conditioner, the air conditioner comprising:

cam means formed at an air suction port at predetermined angle to be moved vertically;

a plurality of shutter means rotated by a interlocking linear motion of the cam means to close or open the suction port and to control continuously the air flow direction, while an extent of each opened angle is so made to be equally seen in the suction port by an optical illusion; and guide means formed at each side of a plurality of shutter means to rotatively support, open and close the plurality of shutter means.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS

Figure 1:
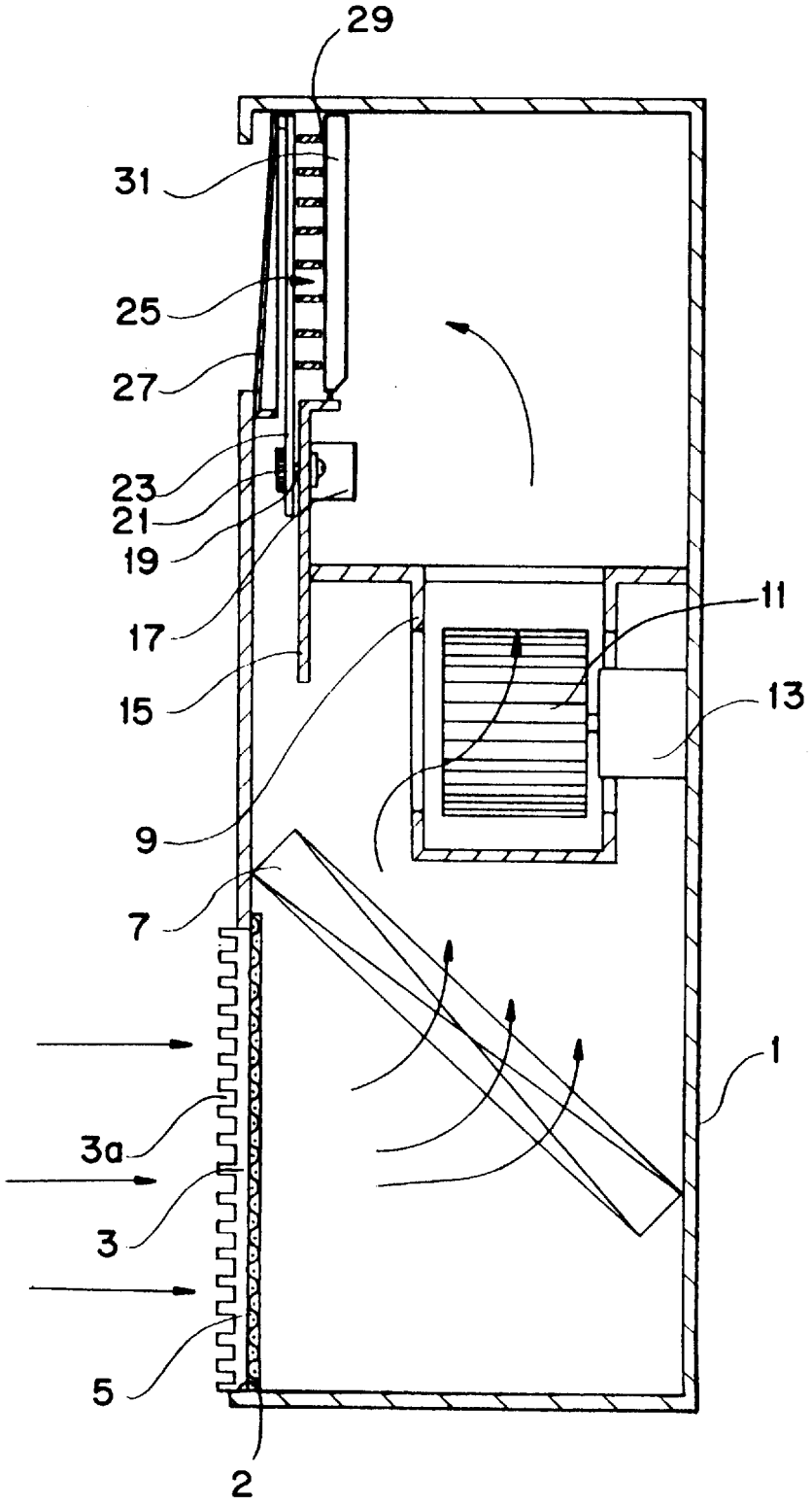
FIG. 1 (PRIOR ART)
FIG. 1 is a side sectional view for illustrating a typical air conditioner.

FIGS. 2 to 7 show an air conditioner according to the first embodiment of this invention. In the present invention, the air conditioner remains the same in overall shape as in the typical air conditioner. Those elements of the air conditioner common to both the present invention and the prior art will thus carry the same reference numerals so that no further explanation is deemed necessary.

As shown in the drawings, reference numerals 50 and 60 denote first and second shutters respectively mounted at a suction port 2 and an exhaust port 25 to thereby close or open the suction port 2 and the exhaust port 25, or to control the air flow direction. The shutters thus prevent an introduction of foreign substances such as dust into a housing 1 through the exhaust port 25 and suction port 2 while the air conditioner is not used.

The first and second shutters 50 and 60 are associated with respective pinion gears 52 and 62, being rotated by the rotating force of drive means 51 and 61. Cam means 53 and 63 are meshed with the pinion gears 52 and 62 to thereby be moved in the vertical directions. A plurality of shutter means 54 and 64 close or open the suction port 2 and the exhaust port 25 respectively, and are rotated by the rotative linear motion of the cam means 53 and 63.

Guide means 55 and 65 are mounted at each side of the plurality of shutter means 54 and 64 to rotatively support and guide the shutter means 54 and 64.

At this time, gears 53*b* and 63*b* are formed at one surface of the cam means 53 and 63 in order to mesh with the pinion gears 52 and 62. Hinge shafts 54*a* and 64*a* are mounted at each side of the plurality of shutter means 54 and 64 to rotatably support the shutter means 54 and 64. Lugs 54*b* and 64*b* are also mounted on the shutter means 54 and 64 and are movably guided in inclined grooves 53*a* and 63*a*, which are formed in the cam means 53 and 63.

Fixed holes 55*a* and 65*a* are formed in the guide means 55 and 65, where the hinge shafts 54*a* and 64*a* of a plurality of shutter means 54 and 64 can be rotatively mounted. Circular guide slots 55*b* and 65*b* are spaced from the fixed grooves 55*a* and 65*a* to receive and guide the lugs 54*b* and 64*b* according to the linear motion of the cam means 53 and 63.

The operational effect of an air conditioner according to the first embodiment of the invention will now be described hereinbelow.

Figure 2:
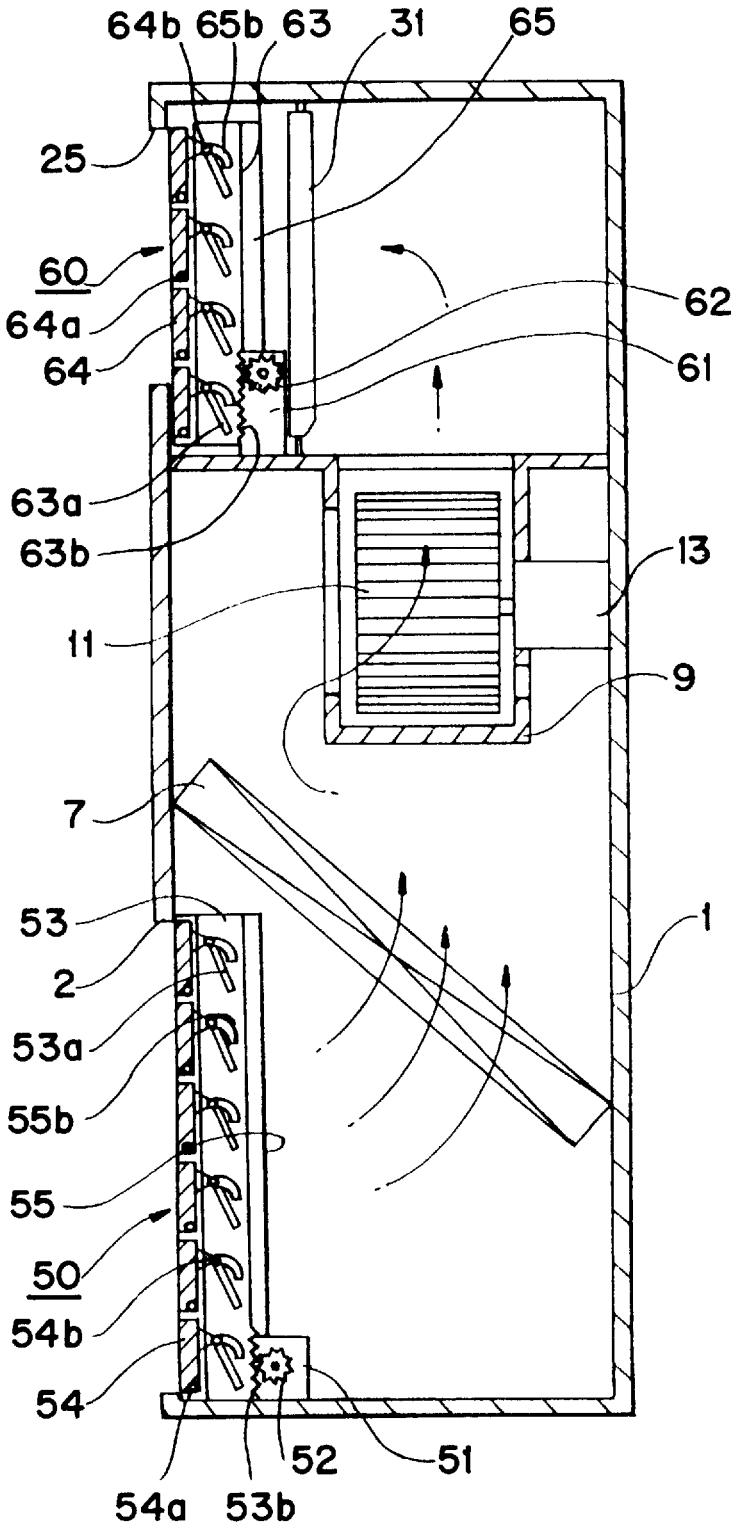
FIG. 2 is a side sectional view for illustrating a closed state of suction ports and exhaust ports of the air conditioner in accordance with a first embodiment of the present invention.

In FIG. 2, when the power is applied to the drive means 51 of the first shutter 50 in order to operate the air conditioner, the pinion gear 52 is rotated by the drive means 51. Therefore, the cam means 53 meshed with one side of the pinion 52 is lifted upward and simultaneously the groove 53*a* is raised up.

As the groove 53*a* is raised by the cam means 53, the lug 54*b* of the shutter means 54 travels along the circular guide slot 55*b*. The shutter means 54 shown in FIG. 3 are rotated at predetermined angles about the axis of the hinge shafts 54*a* to thereby open the suction port 2.

At this time, the large-sized suction port 2 is opened to let a large amount of room air in, thus improving an operational efficiency of the air conditioner.

Figure 3:
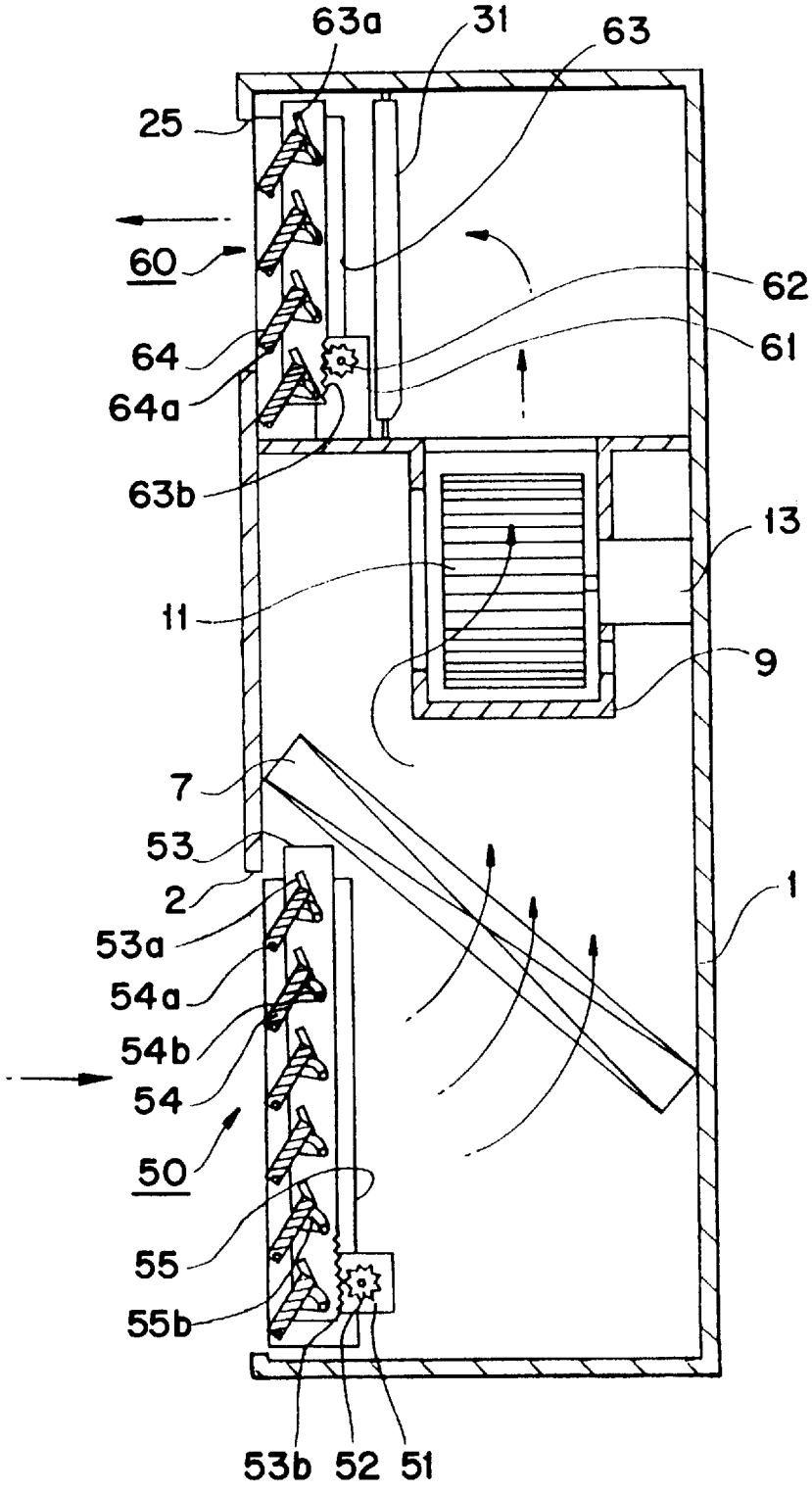
FIG. 3 is a side sectional view for illustrating an opened state of suction ports and exhaust ports of the air conditioner in accordance with the first embodiment of the present invention.
Figure 4:
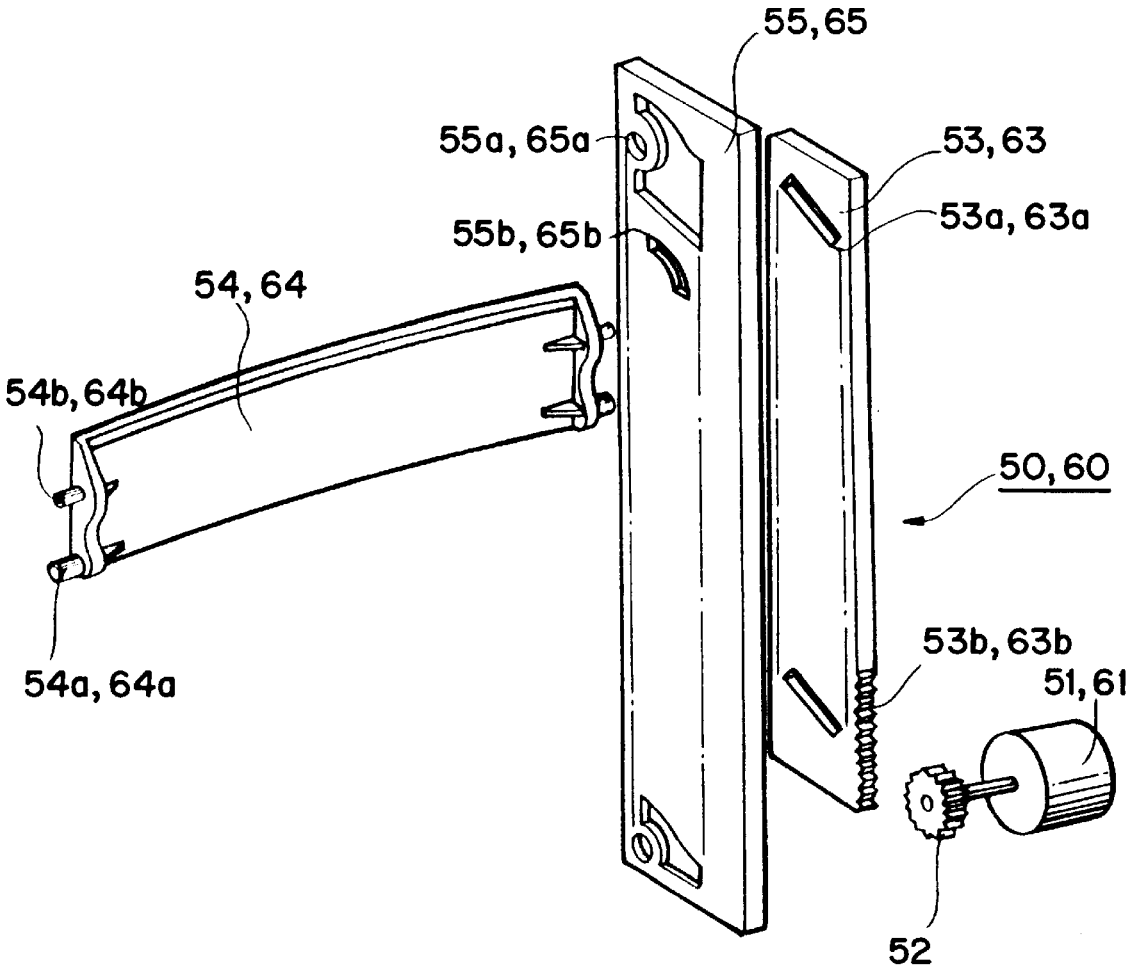
FIG. 4 is a perspective exploded view of principal parts for illustrating a first and a second shutter at the suction ports and exhaust ports in accordance with the first embodiment of the present invention.
Figure 5A:
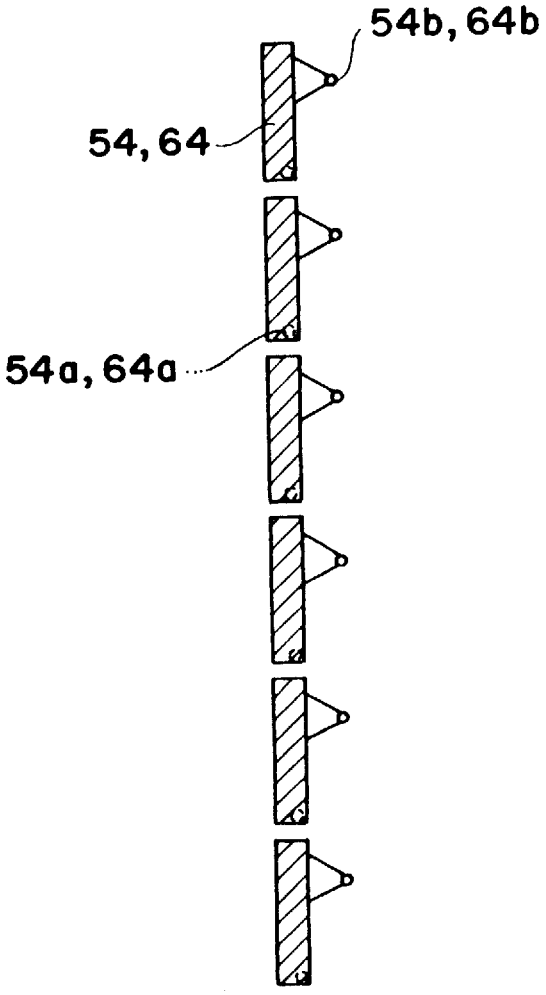
FIG. 5A is a side sectional view for illustrating the shutter in accordance with the first embodiment of the present invention.
Figure 5B:
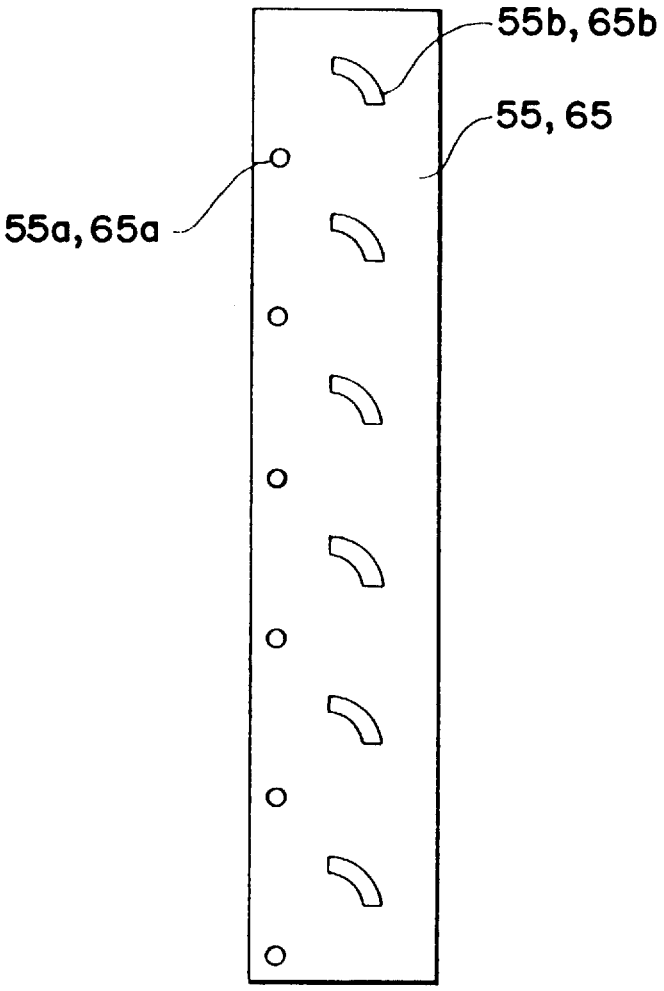
FIG. 5B is a front view for illustrating a guide member in accordance with the first embodiment of the present invention.
Figure 5C:
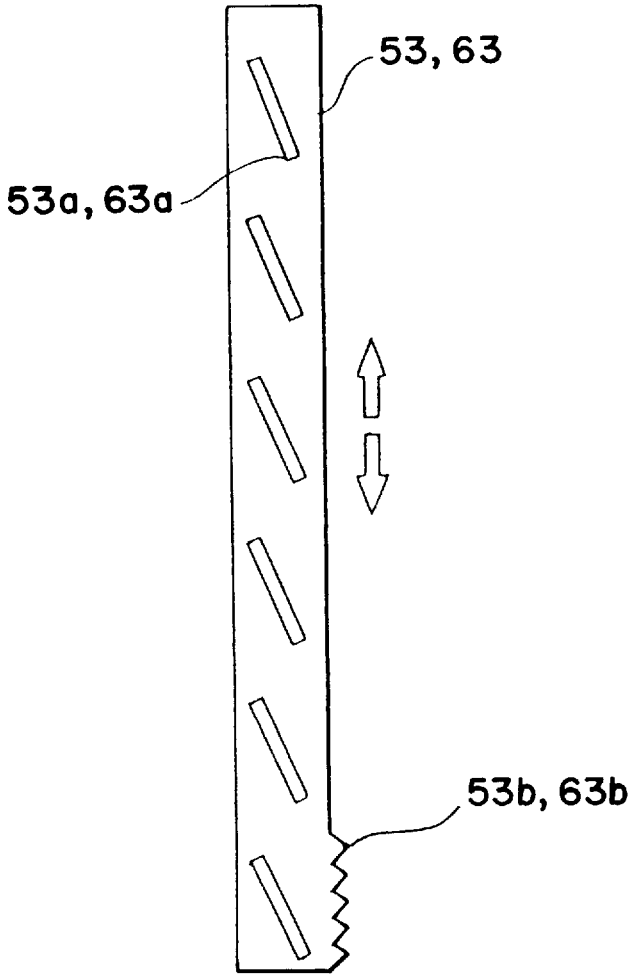
FIG. 5C is a front view for illustrating a cam member in accordance with the first embodiment of the present invention.
Figure 6:
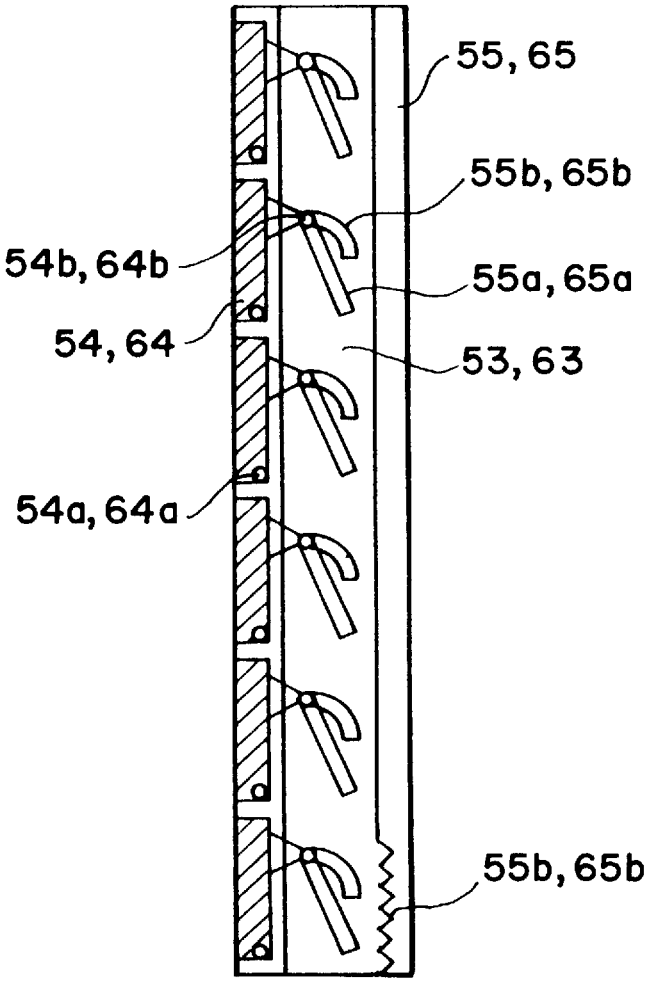
FIG. 6 is a side sectional view of principal parts for illustrating a closed state of suction ports and exhaust ports as shown in FIGS. 5A, 5B and 5C.
Figure 7:
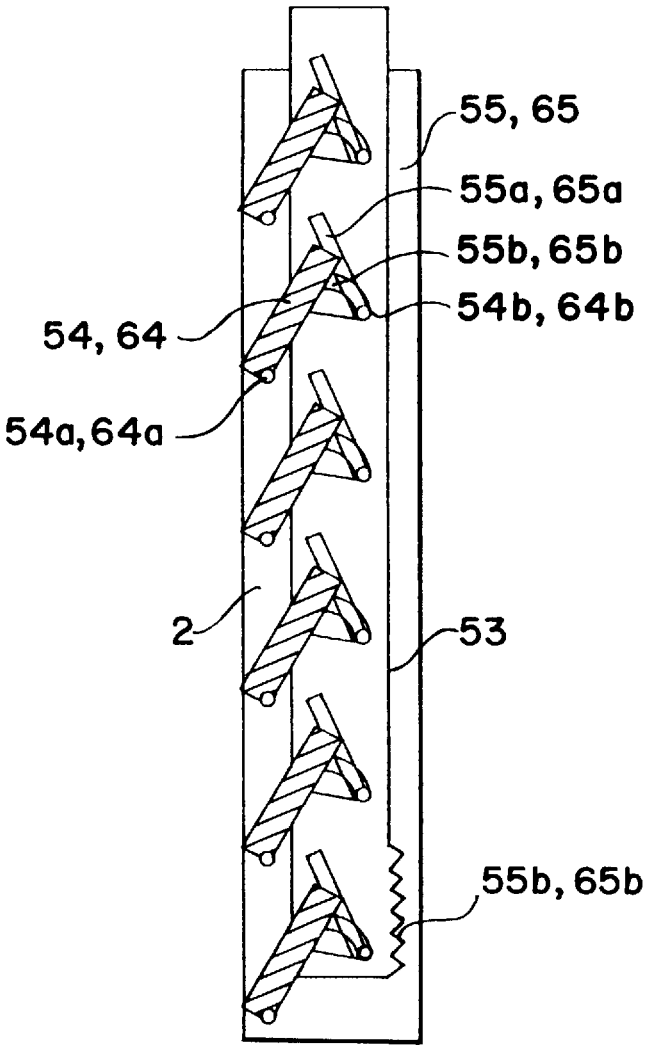
FIG. 7 is a side sectional view of principal parts for illustrating an opened state of suction ports and exhaust ports as shown in FIGS. 5A, 5B and 5C.

Meanwhile, when the pinion 62 is rotated according to the rotation of the driving means 61, the cam means 63 is simultaneously raised and when the cam means 63 is moved upwards the plurality of shutter means 64 are rotated by the guide means 65 to thereby open the exhaust port 25, as shown in FIG. 3.

At this time, the plurality of shutter means 64 serve to control a vertical exhaust air flow direction according to an opening angle thereof, where the angle thereof is controlled by the drive means 61. The first drive means 13 is mounted at a center of the housing 1. When a blower fan 11 is rotated by the drive of the first drive means 13, the air is sucked into the room through the suction port 2.

The sucked air is heated or cooled by the heat exchanger 7, and moved up toward the exhaust port 25 by the duct 9. The air flow direction is controlled horizontally by the rotation of the exhaust grille 31, and simultaneously controlled vertically by the opened angle of the plurality of the shutter means 64 to thereby be discharged indoors to heat or cool the room.

The exhaust port 25 is closed or opened by the plurality of the shutter means 64, which serve as the control grille to control the flow direction of heated or cooled air at the same time.

When the air conditioner is not used, the first drive means 13 is stopped so that the blower fan is stopped. The drive means 51 of the first shutter means 50 rotates in the reverse direction so that the pinion gear 52 rotates in the reverse direction.

The pinion gear 52 serves to lower the cam means 53, so that the lug 54*b* is guided by the circular-shaped guide slot 55*b*. Thus the suction port 2 is closed by the plurality of the shutter means 54 as shown in FIG. 2.

Similarly, the second shutter means 60 disposed at the exhaust port 25 is closed by the reverse operation of the driving means 61.

At this time, the suction port 2 and the exhaust port 25 are completely closed by the plurality of shutter means 52 and 62, which prevent introduction of foreign substances such as dust into the air conditioner and can serve to maintain a good external appearance of the air conditioner.

Figure 8:
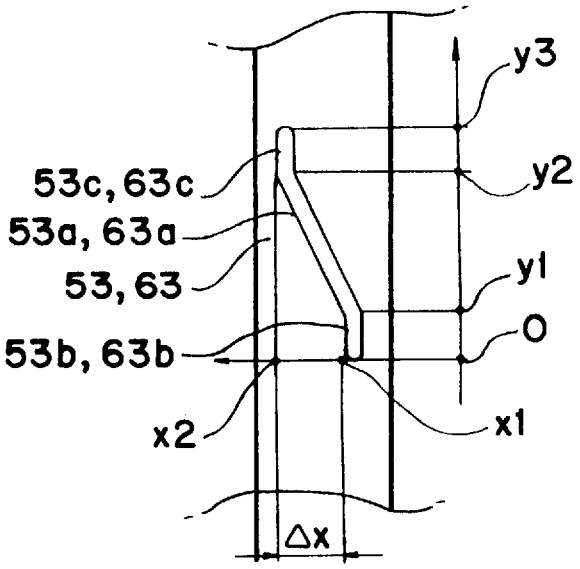
FIG. 8 is a front view for illustrating a construction of a groove of a cam member in accordance with a second embodiment of the present invention.

As described above, the air conditioner has the groove 53*a* formed in the cam means 53 and 63 inclined at predetermined angles, that is not to be taken as limiting. Still other variations and modifications such as a construction where vertical extension ports 53*c* and 63*c* are respectively formed at an upper and a lower side of the inclined grooves 53*a* and 63*a* to control the operation of drive means 51 and 61, for example as a second embodiment shown in FIG. 8, is possible without departing from the spirit and the scope of the present invention.

In other words, when the cam means 53 and 63 are lifted the horizontal displacement in the direction at the extension ports 53*c* and 63*c* is zero in a section from 0 to y1 so that the plurality of shutter means 54 are stationary. In a section from y1 to y2, the displacement in the x direction is $\Delta X$ so that the plurality of shutter means 54 are rotated at predetermined angle. In a section from y2 to y3, the displacement in the x direction is zero so that the plurality of shutter means 54 are stationary.

The reason for providing the vertical ports 53*b*, 53*c* and 63*b*, 63*c*, is that, when the drive means 51 and 61 are operated suddenly or stopped forcedly, no excessive load from the shutters is generated in the drive means 51 and 61 so that the motion of drive means 51 and 61 is controlled. Thus the life of drive means 51 and 61 can be extended.

As described above, there is an advantage in the first and second embodiments of the present invention in that, the air conditioner has a plurality of shutter means which control the suction ports and exhaust ports, and the shutter means are cooperatively rotated by vertically-moving cam means, so that the amount of inlet air is increased according to an enlarged suction port, while improving an operational efficiency of the air conditioner. There is another advantage in that the air conditioner can maintain a good external appearance at the same time, and can control opening and closing of the exhaust port and the air flow direction simultaneously.

FIGS. 9A to 11 show an air conditioner according to the third embodiment of this invention. In the present embodiment, the general shape of the air conditioner remains the same as in the first and second embodiments of present invention. Those elements of the air conditioner common to both the present embodiment and the first and second embodiments will thus carry the same reference numerals so that no further explanation is deemed necessary.

Figure 10:
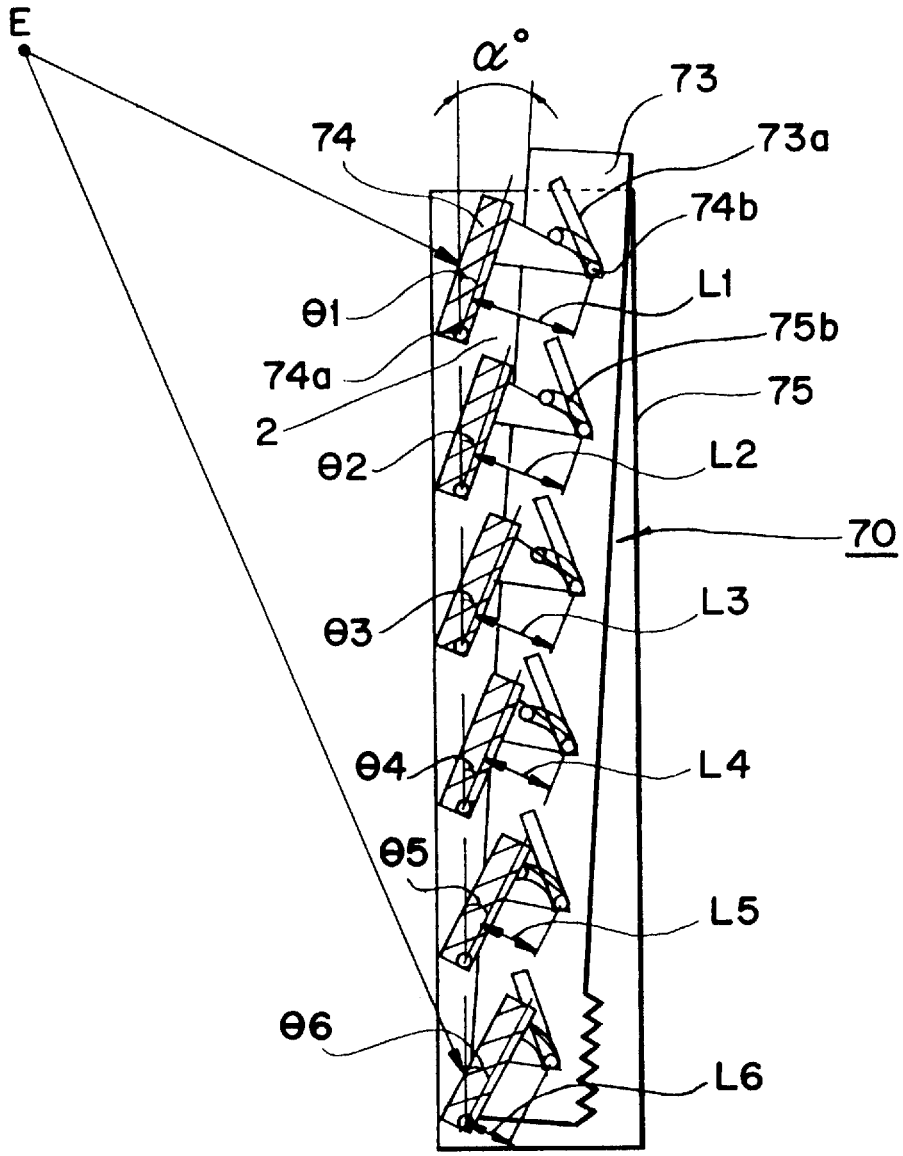
FIG. 10 is a side sectional view of principal parts for illustrating closed state of suction ports and exhaust ports as shown in FIGS. 9A, 9B and 9C.

In FIG. 10, reference numeral 70 denotes angle control means, which closes or opens the suction port 2 and controls the air flow direction, while opening the shutters 74 by different angles $\theta$ which nonetheless appear to be equal to an observer, due to an optical illusion. When the air conditioner is not used, the angle control means prevents introduction of foreign substances such as dust into the housing.

The angle control means 70 includes cam means 73 installed inside the suction port 2 at a predetermined angle $\alpha$ for up/down linear movement, a plurality of shutter means 74 cooperatively rotated by a linear movement of the cam means 73 to thereby close or open the suction port 2, and guide means 75 mounted at each side of shutter means 74 to rotatively support the plurality of the shutter means 74 and simultaneously guide the plurality of shutter means 74.

Figure 9A:
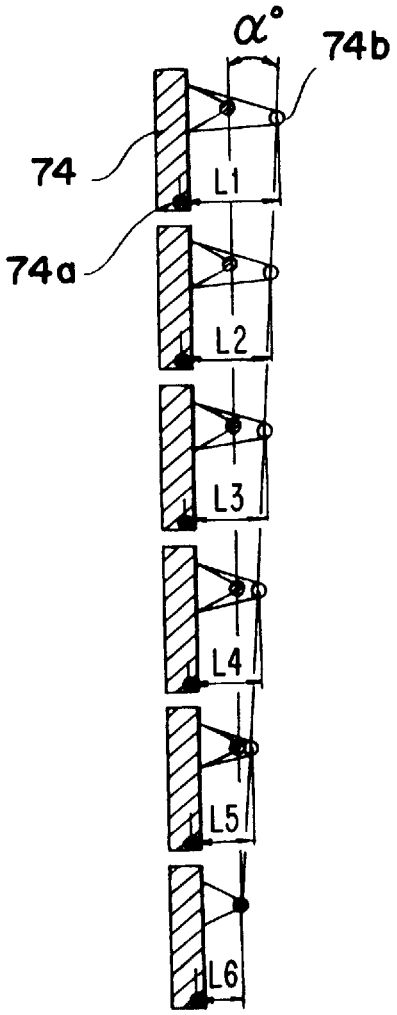
FIG. 9A is a side sectional view for illustrating the shutter in accordance with a third embodiment of the present invention.
Figure 9B:
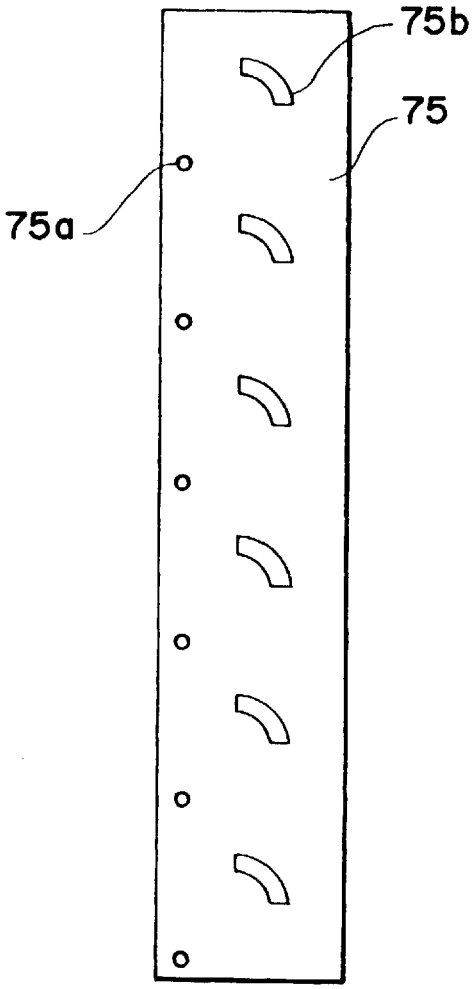
FIG. 9B is a front view for illustrating a guide member in accordance with the third embodiment of the present invention.
Figure 9C:
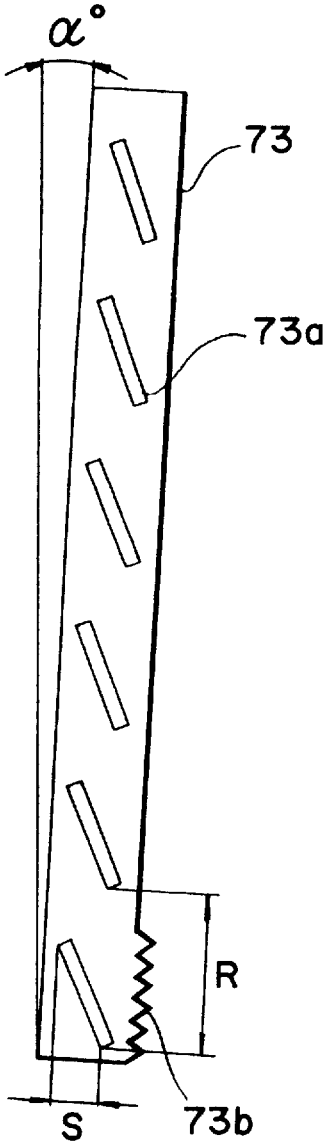
FIG. 9C is a front view for illustrating a cam member in accordance with the third embodiment of the present invention.

At this time, the plurality of inclined grooves 73*a* in the cam means 73 are respectively formed at equal intervals of S and R as shown in FIG. 9C.

The plurality of shutter means 74 each have a hinge shaft 74*a* and a lug 74*b*, which are easily rotated by the cam means 73 having a predetermined angle $\alpha$ relative to vertical, in order to differently control the respective opening angles of the shutters so that distances L1, L2, L3, L4, L5 and L6 between the hinge shaft 74*a* and lug 74*b* are respectively differentiated.

The distances L1, L2, L3, L4, L5 and L6 between the hinge shaft 74*a* and the lug 74*b* decrease from an upper side of cam means 73 to a low side of the cam means 73. The order is L1>L2>L3>L4>L5>L6.

The guide means 75 is respectively formed with a fixed groove 75*a* and a guide slot 75*b* mounted at each side of the plurality of shutter means 74, in order to rotatively guide the plurality of shutter means 74.

The operational effect of the above air conditioner according to the third embodiment of the invention will be described hereinbelow.

When the cam means 73 is lifted up by the drive means, the lug 74*b* follows the guide slot 75*b* of guide mean 75 and is rotated, as shown in FIG. 10. The lug 74*b* rotates each of the shutter means 74 at a predetermined angle.

The distances L1, L2, L3, L4, L5 and L6 between the hinge shaft 74*a* and the lug 74*b* gradually become shorter from an upper side of cam means 73 to a low side of the cam means 73. The order is L1>L2>L3>L4>L5>L6.

The magnitude of the opening angle $\theta$ is gradually increased from an upper side to a lower side of a plurality of shutter means 74. The order is $\theta 1<\theta 2<\theta 3<\theta 4<\theta 5<\theta 6$. When a person views the shutter means from the E position (as shown in FIG. 10), the angles of the upper shutter means 74 appear to be equal to those of the lower shutter means 74 due to an optical illusion.

The above description can be explained in a mathematical manner.

Figure 11:
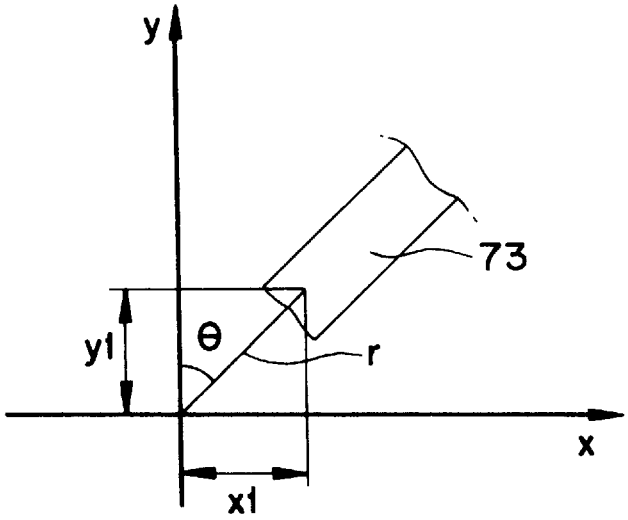
FIG. 11 is a graph for explaining a distance variation of a hinge shaft vs. a lug in accordance with the third embodiment of the present invention.

FIG. 11 is a graph for explaining the distance variation.

$X1=r\sin\theta$ $\theta=\sin-1\ x/r$

We can see from the above formula that the smaller "r" is, the bigger "θ" is. Thus, with regard to the length of "r", which is the distance between the hinge shaft 74*a* and the lug 74*b* at each shutter means 74, the upper shutter means 74 seems to become shorter to the observer, while the lower shutter means seems to become longer, due to the different angles θ.

As described above, there is an advantage in the third embodiment of the present invention in that the shutter means are swung to different opening angles so that the plurality of shutter means seem to be equally opened due to an optical illusion. Thus an external appearance of the air conditioner is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a body forming an air port;

a plurality of parallel blades extending across the air port for opening and closing the air port, the blades mounted for rotation about respective parallel axes;

a cam member movable linearly up and down and connected to the blades for producing rotation of the blades in response to linear movement of the cam member;

a stationary guide member connected to the blades for guiding the rotational movement thereof; and a motor-driven pinion gear meshed with teeth of the cam member for moving the cam member up and down.

2. The air conditioner according to claim 1 wherein each of the blades includes hinge shafts rotatably supporting the blade, and a lug operably connected to both the cam member and the guide member for guiding the rotation of the blade.

3. The air conditioner according to claim 2 wherein each lug is mounted in a curved slot of the guide member, the curved slot being curved about an axis of rotation defined by the hinge shafts.

4. The air conditioner according to claim 3 wherein the lug of each blade is mounted in a groove of the cam member, each groove including a linear section inclined relative to both vertical and horizontal.

5. The air conditioner according to claim 3 wherein each of the grooves of the cam member includes a vertical extension at each end of the linear section thereof.

6. An air conditioner according to claim 1 wherein each blade includes a lug mounted in a groove formed in the cam member, the groove including a linear section inclined relative to both vertical and horizontal, and a vertical extension disposed at each end of the linear section.

7. The air conditioner according to claim 1 wherein the cam member is connected to the blades to rotate the blades by different respective angles for opening the air suction port.

8. The air conditioner according to claim 7 wherein the air port is an air suction port disposed at a lower side of the body, the blades being vertically spaced, and the cam member arranged for rotating the blades by respective angles relative to vertical, the angles becoming gradually larger from an uppermost blade to a lowermost blade.

9. An air conditioner comprising:

a body forming an air port;

a plurality of parallel horizontal blades extending across the air port for opening and closing the air port, the blades being rotatable about respective horizontal axes;

a stationary guide member connected to the blades for guiding the rotational movement of the blades; and a motor-driven cam member movable linearly up and down and connected to the blades for producing rotation of the blades about the respective axes by different respective angles.

10. The air conditioner according to claim 9 wherein the air port is an air suction port located at a lower side of the body, the cam member arranged for rotating the blades by respective angles with respect to vertical, the angles becoming gradually larger from an uppermost blade to a lowermost blade.

11. The air conditioner according to claim 9 wherein each blade includes a lug mounted in an inclined groove of the cam member and in a curved groove of the guide member, a distance from the lug to the axis of rotation being different for respective blades.

* * * * *